US006394622B1

(12) United States Patent
Macek

(10) Patent No.: US 6,394,622 B1
(45) Date of Patent: May 28, 2002

(54) MULTIPLE WEAPON SELF DEFENSE DEVICE

(76) Inventor: David W. Macek, 8020 S. Massasoit St., Burbank, IL (US) 60459

( * ) Notice: Subject to any disclaimer, the term of this patent is extended or adjusted under 35 U.S.C. 154(b) by 0 days.

(21) Appl. No.: 09/591,056

(22) Filed: Jun. 9, 2000

(51) Int. Cl.[7] ..... F21S 19/00; F21S 9/00

(52) U.S. Cl. ..... 362/228; 362/184; 362/251; 362/96; 362/208

(58) Field of Search ..... 362/184, 228, 362/190, 191, 96, 208, 251

(56) References Cited

U.S. PATENT DOCUMENTS

| | | | | | |
|---|---|---|---|---|---|
| 4,432,043 | A | | 2/1984 | Yuen | |
| 4,486,807 | A | * | 12/1984 | Yanez | 361/232 |
| 4,842,277 | A | | 6/1989 | Lacroix | |
| 4,982,645 | A | * | 1/1991 | Abboud | 89/1.11 |
| 5,041,951 | A | | 8/1991 | Fan | |
| 5,060,123 | A | | 10/1991 | Arnold | |
| 5,331,523 | A | * | 7/1994 | Delzer | 362/96 |
| D351,674 | S | | 10/1994 | Journeau et al. | |
| 5,420,766 | A | * | 5/1995 | Hollis | 362/96 |
| 5,549,220 | A | * | 8/1996 | Whalen | 222/1 |
| 5,786,546 | A | * | 7/1998 | Simson | 102/438 |
| 5,839,821 | A | * | 11/1998 | LeZotte | 362/253 |
| 5,971,562 | A | * | 10/1999 | Yang | 362/184 |
| 5,973,477 | A | * | 10/1999 | Chang | 320/114 |
| 5,988,450 | A | * | 11/1999 | Cassarino | 222/192 |
| 6,052,051 | A | * | 4/2000 | Whalen | 362/425.5 |
| D425,228 | S | * | 5/2000 | Kibler | D26/46 |

* cited by examiner

*Primary Examiner*—Sandra O'Shea
*Assistant Examiner*—Jacob Y. Choi

(57) ABSTRACT

A light-emitting and self-defense device of the invention provides a flashlight along with a self-defense device and includes an elongate housing having a head portion, a handle portion, a transparent front end, an open back end, and side walls. A light-emitting member is securely and removably disposed in the head portion for shining a beam of light through the transparent front end. A cover member is securely and removably attached to the elongate housing for removably closing the open back end thereof. A carrying assembly for carrying the elongate housing is provided. A self-defense assembly for defending oneself includes a powerful strobe light. A power source assembly energizes the light-emitting member and the strobe light.

3 Claims, 4 Drawing Sheets

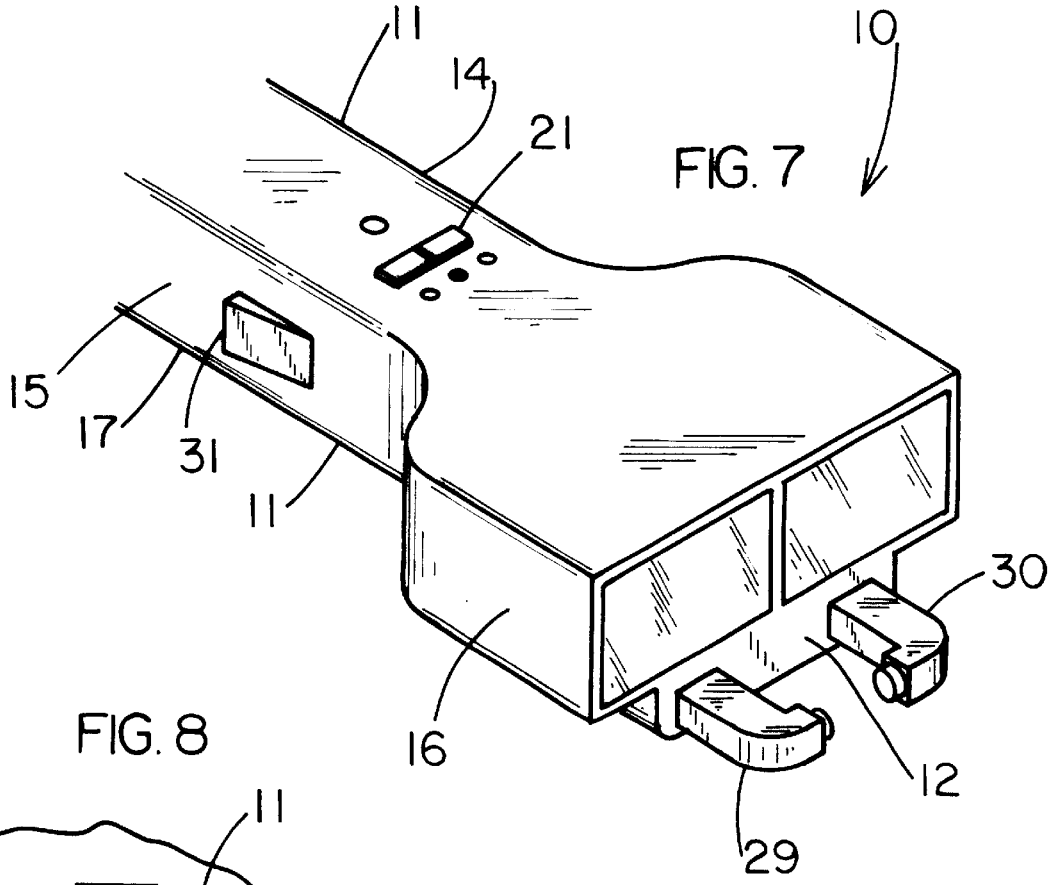
FIG. 7
FIG. 8
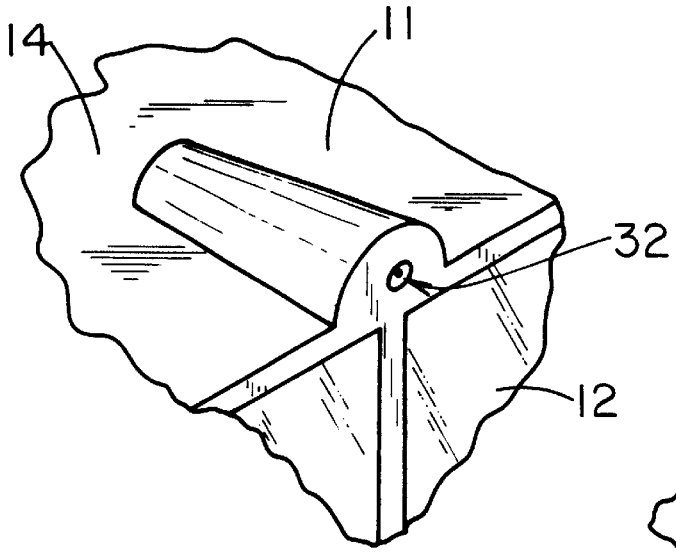
FIG. 9
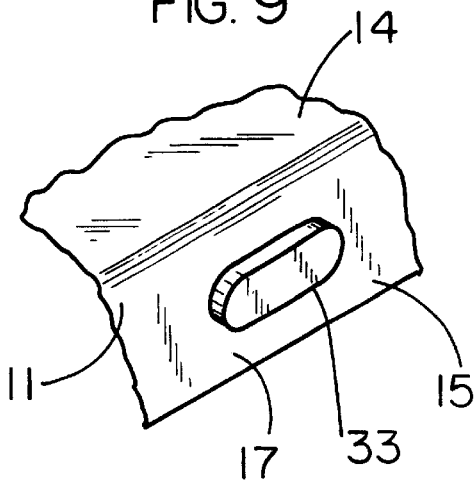

MULTIPLE WEAPON SELF DEFENSE DEVICE

BACKGROUND OF THE INVENTION

1. Field of the Invention

The present invention relates to a self-defense flashlight and more particularly pertains to a new light-emitting and self-defense device for providing a flashlight along with a self-defense device.

2. Description of the Prior Art

The use of a self-defense flashlight is known in the prior art. More specifically, a self-defense flashlight heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,486,807; 4,432,043; 5,060,123; 4,842,277; 5,041,951; and U.S. Pat. No. Des. 351,674.

While these devices fulfill their respective, particular objectives and requirements, the aforementioned patents do not disclose a new light-emitting and self-defense device. The inventive device includes an elongate housing having a head portion, a handle portion, a transparent front end, an open back end, and side walls; and also includes a light-emitting member securely and removably disposed in the head portion for shining a beam of light through the transparent front end; and further includes a cover member being securely and removably attached to the elongate housing for removably closing the open back end thereof; and also includes a carrying assembly for carrying the elongate housing; and further includes a self-defense assembly for defending oneself including a powerful strobe light; and also includes a power source assembly for energizing the light-emitting member and the strobe light.

In these respects, the light-emitting and self-defense device according to the present invention substantially departs from the conventional concepts and designs of the prior art, and in so doing provides an apparatus primarily developed for the purpose of providing a flashlight along with a self-defense device.

SUMMARY OF THE INVENTION

In view of the foregoing disadvantages inherent in the known types of self-defense flashlight now present in the prior art, the present invention provides a new light-emitting and self-defense device construction wherein the same can be utilized for providing a flashlight along with a self-defense device.

The general purpose of the present invention, which will be described subsequently in greater detail, is to provide a new light-emitting and self-defense device which has many of the advantages of the self-defense flashlight mentioned heretofore and many novel features that result in a new light-emitting and self-defense device which is not anticipated, rendered obvious, suggested, or even implied by any of the prior art self-defense flashlight, either alone or in any combination thereof.

To attain this, the present invention generally comprises an elongate housing having a head portion, a handle portion, a transparent front end, an open back end, and side walls; and also includes a light-emitting member securely and removably disposed in the head portion for shining a beam of light through the transparent front end; and further includes a cover member being securely and removably attached to the elongate housing for removably closing the open back end thereof; and also includes a carrying assembly for carrying the elongate housing; and further includes a self-defense assembly for defending oneself including a powerful strobe light; and also includes a power source assembly for energizing the light-emitting member and the strobe light.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light-emitting and self-defense device which has many of the advantages of the self-defense flashlight mentioned heretofore and many novel features that result in a new light-emitting and self-defense device which is not anticipated, rendered obvious, suggested, or even implied by any of the prior art self-defense flashlight, either alone or in any combination thereof.

It is another object of the present invention to provide a new light-emitting and self-defense device which may be easily and efficiently manufactured and marketed.

It is a further object of the present invention to provide a new light-emitting and self-defense device which is of a durable and reliable construction.

An even further object of the present invention is to provide a new light-emitting and self-defense device which is susceptible of a low cost of manufacture with regard to both materials and labor, and which accordingly is then susceptible of low prices of sale to the consuming public, thereby making such light-emitting and self-defense device economically available to the buying public.

Still yet another object of the present invention is to provide a new light-emitting and self-defense device which provides in the apparatuses and methods of the prior art some of the advantages thereof, while simultaneously overcoming some of the disadvantages normally associated therewith.

Still another object of the present invention is to provide a new light-emitting and self-defense device for providing a flashlight along with a self-defense device.

Yet another object of the present invention is to provide a new light-emitting and self-defense device which includes an elongate housing having a head portion, a handle portion, a transparent front end, an open back end, and side walls; and also includes a light-emitting member securely and removably disposed in the head portion for shining a beam of light through the transparent front end; and further includes a cover member being securely and removably attached to the elongate housing for removably closing the open back end thereof; and also includes a carrying assembly for carrying the elongate housing; and further includes a self-defense assembly for defending oneself including a powerful strobe light; and also includes a power source assembly for energizing the light-emitting member and the strobe light.

Still yet another object of the present invention is to provide a new light-emitting and self-defense device that effectively has two uses in one product.

Even still another object of the present invention is to provide a new light-emitting and self-defense device that effectively gives a vulnerable person a way of defending oneself against attackers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective view of the third embodiment of the present invention.

FIG. 8 is a perspective view of the fourth embodiment of the present invention.

FIG. 9 is a detailed perspective view of the spray-actuating member of the fourth embodiment of the present invention.

DESCRIPTION OF THE PREFERRED EMBODIMENT

Figure 1:
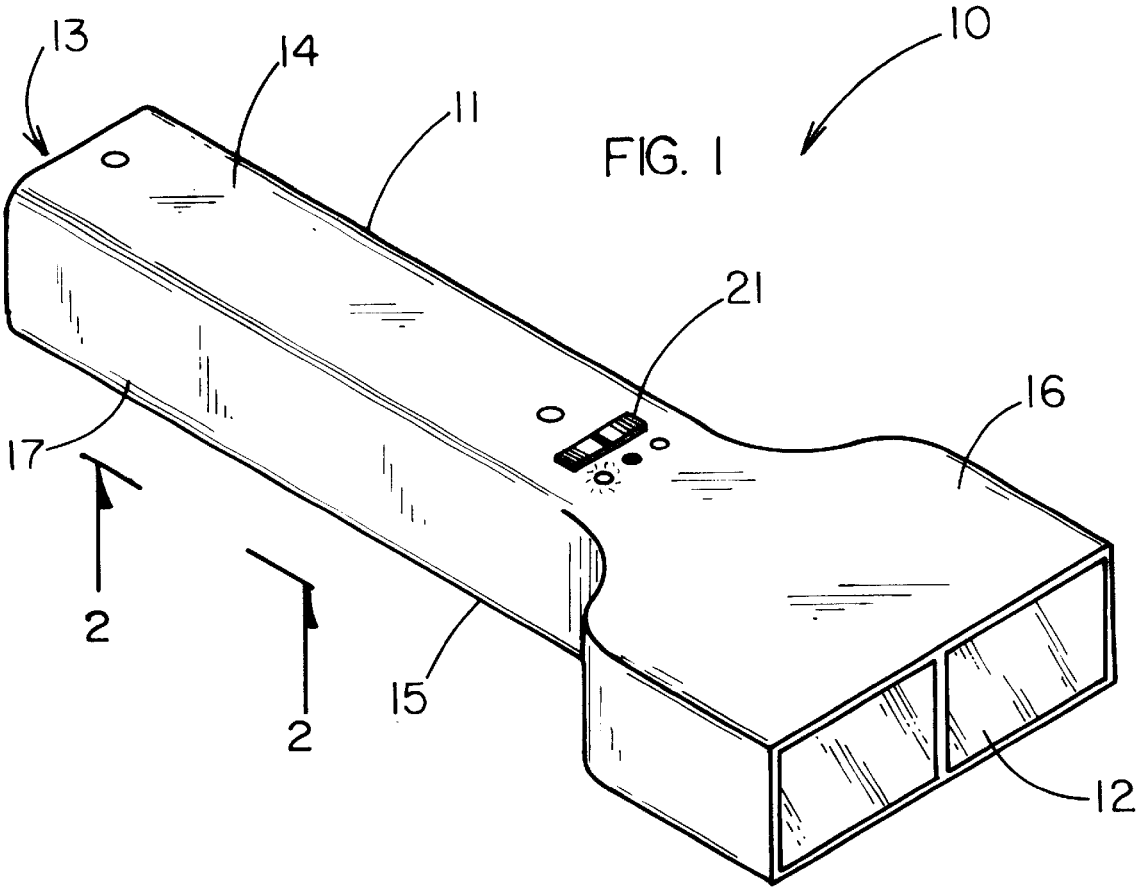
FIG. 1 is a perspective view of a new light-emitting and self-defense device according to the present invention.
Figure 2:
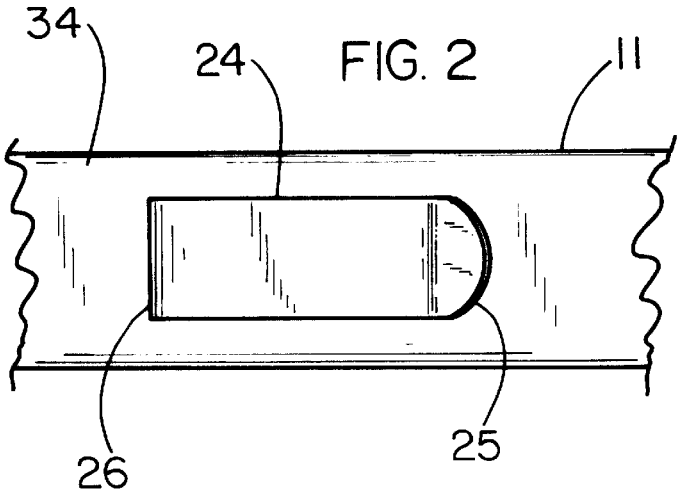
FIG. 2 is a detailed side elevational view of the clip member of the first embodiment of the present invention.
Figure 3:
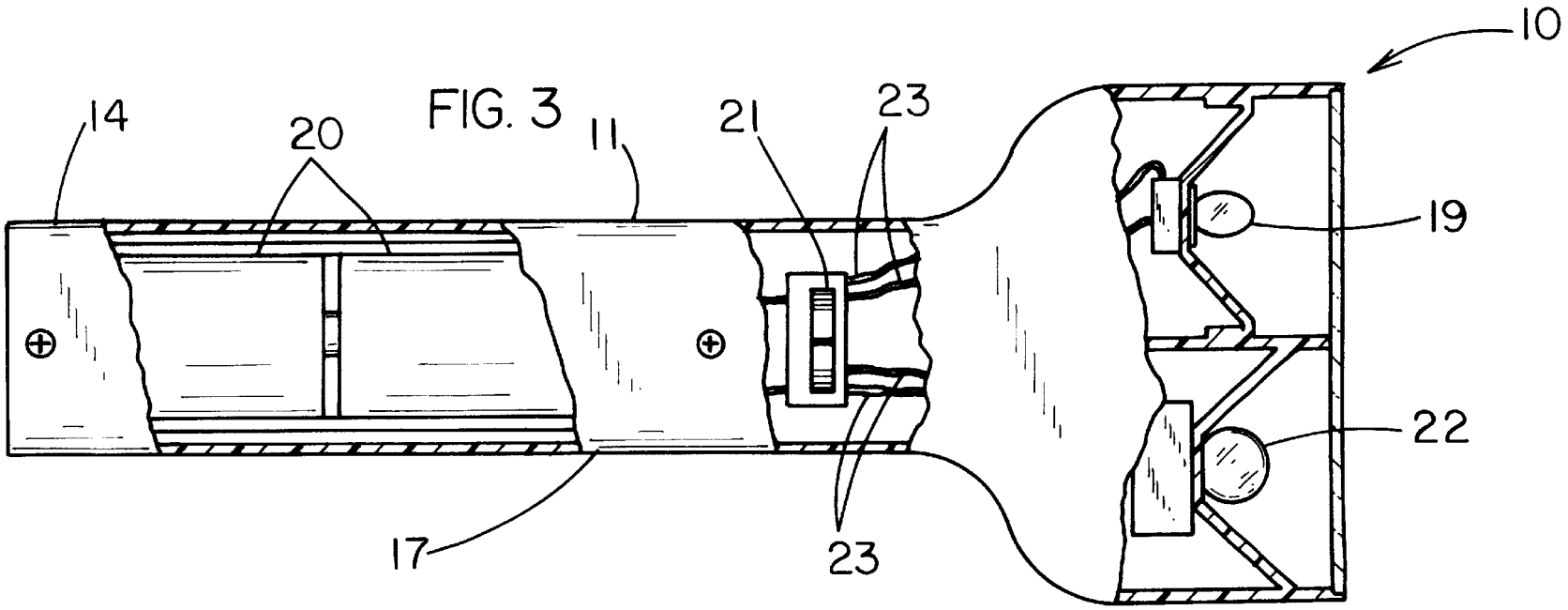
FIG. 3 is a cutaway side elevational view of the present invention.
Figure 4:
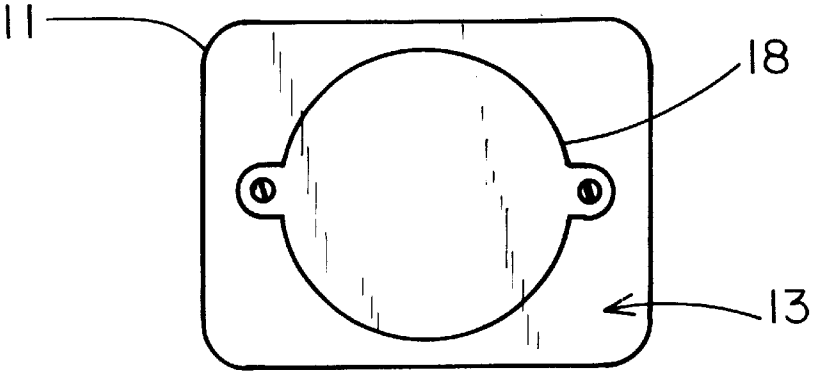
FIG. 4 is a rear elevational view of the present invention.
Figure 6:
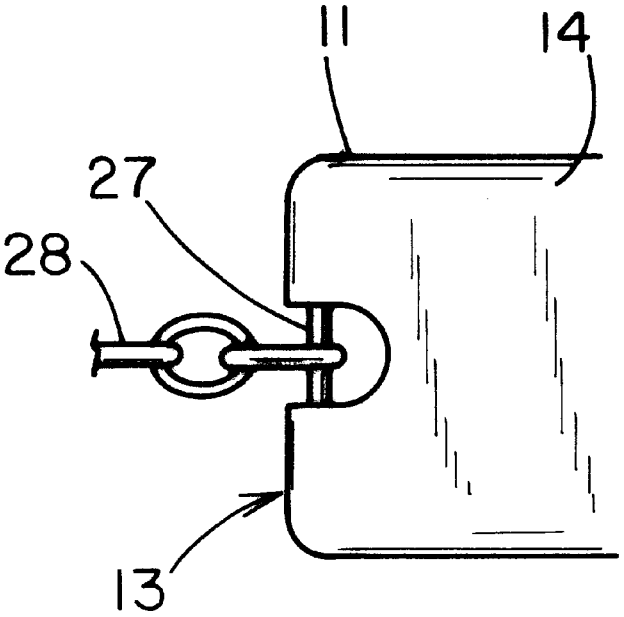
FIG. 6 is a detailed side elevational view of the second embodiment of the present invention.
Figure 5:
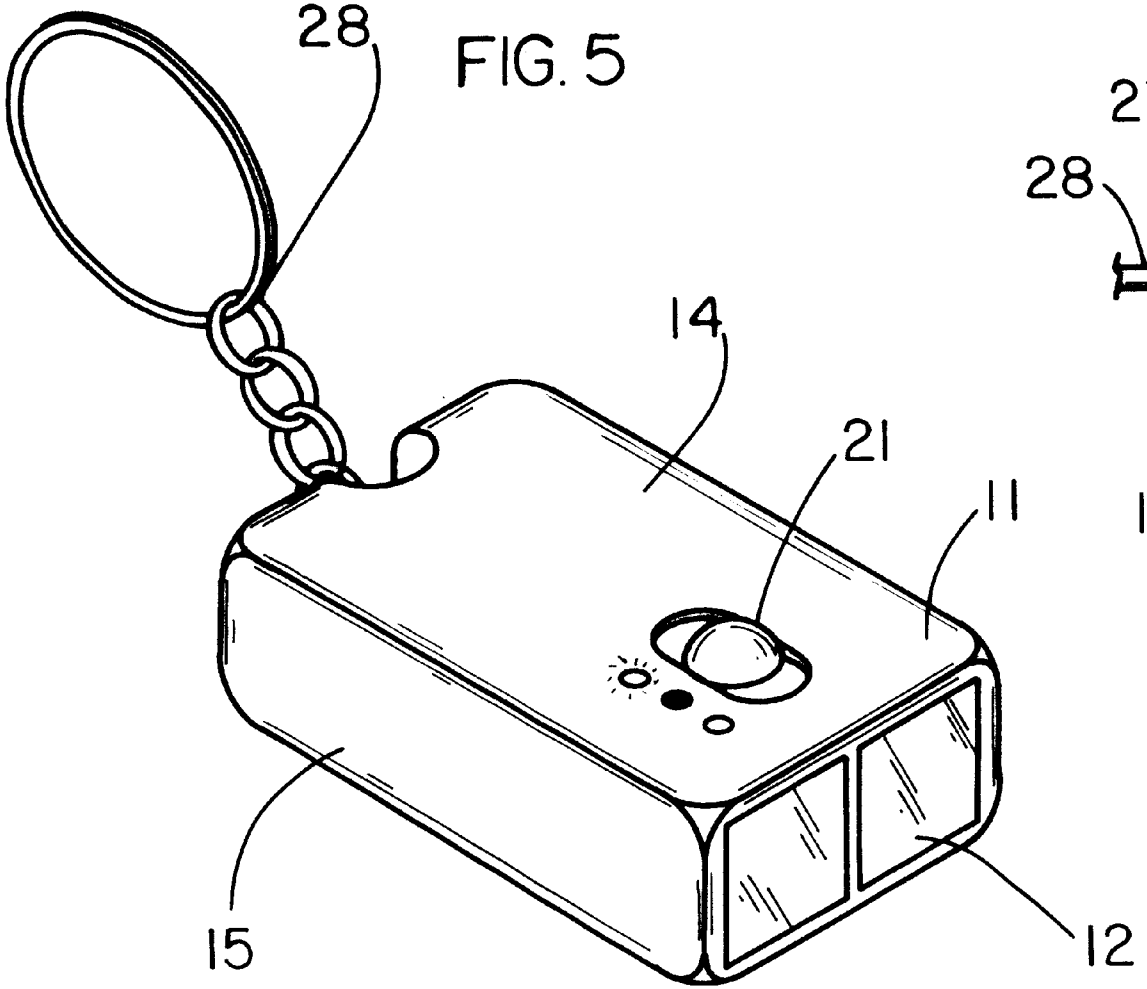
FIG. 5 is a perspective view of the second embodiment of the present invention.

With reference now to the drawings, and in particular to FIGS. 1 through 9 thereof, a new light-emitting and self-defense device embodying the principles and concepts of the present invention and generally designated by the reference numeral 10 will be described.

As best illustrated in FIGS. 1 through 9, the light-emitting and self-defense device 10 generally comprises an elongate housing 11 having a head portion 16, a handle portion 17, a transparent front end 12, an open back end 13, and side walls 14,15,34. The head portion 16 is enlarged relative to the handle portion 17 with the head portion 16 being partitioned into two halves.

A light-emitting member 19 is securely, conventionally and removably disposed in the head portion 16 for shining a beam of light through the transparent front end 12. The light-emitting member 19 essentially occupies approximately one-half of the head portion 16 and shines a beam of light through approximately one-half of the transparent front end 12 of the housing 11.

A cover member 18 is securely and removably attached to the elongate housing 11 for removably closing the open back end 13 thereof. A means for defending oneself includes a powerful strobe light 22 with the strobe light 22 being securely, conventionally, and removably disposed in the head portion 16 of the elongate housing 11 for shining a powerful beam of light through the transparent front end 12 of the elongate housing 11. The strobe light 22 essentially occupies approximately the other one-half of the head portion 16 and shines a powerful beam of light through the other approximately one-half of the transparent front end 12 of the elongate housing 11.

A power source means for energizing the light-emitting member 19 and the strobe light 22 includes batteries 20 being removably disposed inside the handle portion 17 of the elongate housing 11 through the open back end 13, and also includes a switch 21 movably and conventionally mounted to and disposed in one of the walls 14 of the elongate housing 11 and being connected to the batteries 20 with wires 23 and to the light-emitting member 19 and the strobe light 22 also with wires 23.

As a first embodiment, a means for carrying the elongate housing 11 includes a clip member 24 having a first end 25 and a second end 26 which is securely and conventionally attached to one of the side walls 34 of the elongate housing 11 with the first end 25 being biasedly contactable to the elongate housing 11 for carrying the elongate housing 11 upon a user's person.

As a second embodiment, the means for carrying the elongate housing 11 includes a key-chain support member 27 securely and conventionally attached at the back end 13 of the elongate housing 11 and also includes a key-chain member 28 securely and conventionally attached to the key-chain support member 27.

As a third embodiment, the means for defending oneself further includes a pair of electrode-emitting prongs 29,30 being spaced apart and being securely and conventionally attached at and extending from the front end 12 of the elongate housing 11, and also includes a trigger switch 31 movably disposed in one of the side walls 15 of the elongate housing 11 and being conventionally connected to the batteries 20 and to the electrode-emitting prongs 29,30 for energizing the electrode-emitting prongs 29,30 for electrically shocking an attacker.

As a fourth embodiment, the means for defending oneself also includes a spray nozzle 32 being disposed in the front end 12 of the elongate housing 11, and also includes a spray-actuating member 33 depressibly and conventionally disposed in one of the side walls 15 of the elongate housing 11 with the elongate housing 11 being adapted to store a pepper-concentrated liquid for being dispensed through the spray nozzle 32 by the spray-actuating member 33 to ward off attackers.

In use, the user can carry this light-emitting and self-defense device 10 for not only being used as a flashlight when needed but also as a self-defense device to defend oneself against attackers by either shining a blinding beam of light in the eyes of the attacker electrically shocking the attacker with the electrode-emitting prongs 29,30 or spraying a pepper-concentrated liquid toward the attackers.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A self-defense device comprising:

an elongate housing having a head portion, a handle portion, a transparent front end, an open back end, and side walls;

a light source disposed in said head portion for shining a beam of light through said transparent front end;

a cover member removably attached to said elongate housing for removably closing said open back end thereof;

a strobe light source disposed in said head portion for shining rapidly intermittent beams of light though said transparent front end; and a pair of spaced electrode prongs mounted on said housing and extending forwardly from said front end of said elongate housing adjacent to said light source and said strobe light source;

wherein said head portion is enlarged in width relative to said handle portion;

batteries being disposed inside said handle portion of said housing and being removable through said open back end of said housing, and a switch movably mounted on said housing and being electrically connected to said batteries and to said light source and said strobe light source;

wherein said head portion is partitioned into two halves, said light source occupying a first one of said halves of said head portion and shines a beam of light through approximately one-half of said transparent front end of said housing, said strobe light source occupying a second one of said halves of said head portion for shining a light through the other approximately one-half of said transparent front end of said elongate housing;

means for carrying said elongate housing;

a trigger switch movably disposed in one of said side walls of said housing and being connected to said electrode prongs for selectively energizing said electrode prongs for electrically shocking an attacker contacting said electrode prongs; and a spray nozzle being disposed in said front end of said elongate housing adjacent to said light source and said strobe light source.

2. A self-defense device as described in claim 1, wherein said means for carrying said elongate housing including a key-chain support member attached to said back end of said elongate housing and also including a key-chain member attached to said key-chain support member.

3. A self-defense device as described in claim 1, wherein said means for carrying said elongate housing includes a clip member having a first end and a second end, said second end being attached to one of said side walls of said elongate housing with said first end being biased into contact with said elongate housing for carrying said elongate housing upon a user's person.

* * * * *